US005232561A

United States Patent [19]

Furuya

[11] Patent Number: 5,232,561

[45] Date of Patent: Aug. 3, 1993

[54] ELECTROLYTIC METHOD OF PREPARING COMPOUNDS WITH A GAS PERMEABLE ELECTRODE

[75] Inventor: Nagakazu Furuya, No. 4-3-31, Ohte 2-chome, Kofu-shi, Yamanashi, Japan

[73] Assignees: Tanaka Kikinzoku Kogyo K.K.; Nagakazu Furuya, both of Japan

[21] Appl. No.: 686,842

[22] Filed: Apr. 17, 1991

Related U.S. Application Data

[63] Continuation of Ser. No. 451,193, Dec. 15, 1989, abandoned.

[51] Int. Cl.[5] ..... C25B 3/00; C25B 11/12

[52] U.S. Cl. ..... 204/73 R; 204/72; 204/73 A; 204/74; 204/81; 204/290 R

[58] Field of Search ..... 204/81, 73 R, 72, 73 A, 204/74

[56] References Cited

U.S. PATENT DOCUMENTS 3,682,793 8/1972 Seko et al. ..... 204/73 A
3,981,749 9/1976 Fukuda et al. ..... 429/41
4,240,882 12/1980 Ang et al. ..... 204/266
4,253,921 3/1981 Baldwin et al. ..... 204/72
4,444,852 4/1984 Liu et al. ..... 429/42
4,566,957 1/1986 Trocciola ..... 204/73 A
4,581,116 4/1986 Plowman et al. ..... 204/284
4,931,168 6/1990 Watanabe et al. ..... 429/42

FOREIGN PATENT DOCUMENTS 0185788 10/1984 Japan ..... 204/72

*Primary Examiner*—John Niebling
*Assistant Examiner*—Kathyrn Gorgos
*Attorney, Agent, or Firm*—Klauber & Jackson

[57] ABSTRACT

A method of electrolytically producing an organic compound is disclosed, wherein an organic solvent and an electrolyte which is dissolved therein is placed in an anodic or cathodic chamber. The chambers are separated by a semi-permeable membrane. At least one of the electrodes is a gas permeable electrode which includes a reaction layer joined together with the gas permeable layer. The reaction layer is composed of minute hydrophilic and hydrophobic carbon black, and the gas permeable layer is composed of minute hydrophobic carbon black.

10 Claims, 1 Drawing Sheet

ELECTROLYTIC METHOD OF PREPARING COMPOUNDS WITH A GAS PERMEABLE ELECTRODE

This application is a continuation of application Ser. No. 451,193, filed Dec. 15, 1989 now abandoned.

BACKGROUND OF THE INVENTION

1. Field of the Invention

The present invention relates to an electrolysis apparatus for effecting electrolysis of an organic electrolytic solution comprising an organic solvent and an electrolyte dissolved therein to obtain an organic compound.

2. Description of the Background Art

In a conventional electrolysis apparatus, in order to obtain an organic compound by electrolysis of an organic electrolytic solution comprising an organic solvent and an electrolyte dissolved therein, an anode and a cathode are inserted in the organic electrolytic solution contained in an electrolytic cell, and electric power is suppled to the two electrodes. In another conventional electrolysis apparatus, as shown in FIG. 1, a diaphragm 2 such as an ion exchange membrane is provided in an electrolytic cell 1 to separate the cell 1 into cathode and anode compartments 3 and 5, and an organic electrolytic solution 4 comprising an organic solvent and an electrolyte dissolved therein, and an electrolytic aqueous solution 6 are contained in the cathode and anode compartments 3 and 5, respectively. Electric power (not shown) is supplied to a cathode 7 and an anode 8 inserted in the organic electrolytic solution 4 and the electrolytic aqueous solution 6 of the cathode and anode compartments 3 and 5 to perform the electrolysis of the organic electrolytic solution to obtain an organic compound, for example, adiponitrile or the like.

In such conventional electrolysis apparatuses, since a lead plate is usually used for the anode, the organic compound adsorbs over the surface of the anode without question in the cell with no diaphragm, and the organic compound passing through the diaphragm also adsorbs over the surface of the anode even in the cell having the diaphragm. Thus, the surface area where the current flows is decreased to reduce the electric current density, resulting in that the production efficiency or productivity of the organic compound is largely reduced.

In this case, considering the productivity, the voltage is to be increased to invite the acceleration of the electrode elution. Further, on the surface of the lead (Pb) anode, a $\beta$-$PbO_2$ film grows to thicken during the operation and a peeling of the $\beta$-$PbO_2$ film off the anode is caused. Accordingly, the anode becomes more slender, and the distance between the electrodes is enlarged to further cause the reduction of the electric current density.

Relating to the cathode, even when the cathode is prepared by a porous material in order to increase the reaction speed, the pores of the cathode are occupied by the gas such as hydrogen generated from the cathode, and hence, the reaction speed is not so increased and becomes equal to that of the flat plate cathode. Furthermore, the reaction gas such as carbon monoxide (CO) or the like is hard to dissolve in the electrolytic solution, and pressurization is sometimes required.

SUMMARY OF THE INVENTION

Accordingly, it is an object of the present invention to provide an electrolysis apparatus, free from the aforementioned defects and disadvantages of the prior art, which is capable of improving production efficiency or productivity of an organic compound.

In accordance with one aspect of the present invention, there is provided an electrolysis apparatus, comprising a cell having a diaphragm therein for defining cathode and anode compartments for containing an organic electrolytic solution and an electrolytic aqueous solution, respectively, and a cathode and an anode inserted in the respective cathode and anode compartments, at least one of the cathode and anode comprising a gas permeable electrode including a reaction layer composed of minute hydrophilic and hydrophobic portions.

In accordance with another aspect of the present invention, there is provided an electrolysis apparatus, comprising a cell for containing an organic electrolytic solution comprising an organic solvent and an electrolyte dissolved therein, and a cathode and an anode inserted in the organic electrolytic solution, at least one of the cathode and anode comprising a gas permeable electrode including a reaction layer composed of minute hydrophilic and hydrophobic portions.

BRIEF DESCRIPTION OF THE DRAWINGS

The above and other objects, features and advantages of the present invention will more fully appear from the following description of the preferred embodiments with reference to the accompanying drawings, in which.

DESCRIPTION OF THE PREFERRED EMBODIMENT

Figure 2:
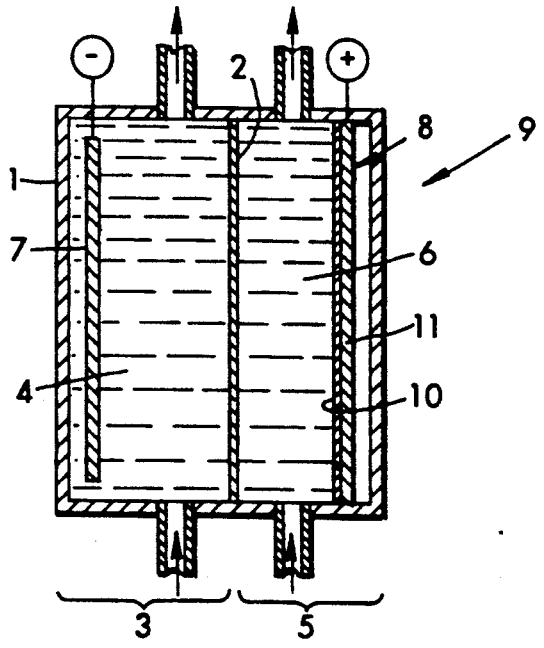
FIG. 2 is a longitudinal cross section of one embodiment of an electrolysis apparatus according to the present invention.

Referring now to the drawings, there is shown in FIG. 2 one embodiment of an electrolysis apparatus according to the present invention.

In the drawing, a diaphragm 2 such as an ion exchange membrane is provided in an electrolytic cell 1 to separate the cell 1 into cathode and anode compartments 3 and 5. An organic electrolytic solution 4 containing an organic solvent of 20% by weight of potassium tetraethylammonium-p-toluensulfonate and an electrolyte of 30% by weight of acrylonitrile dissolved therein is contained in the cathode compartment 3, and an electrolytic aqueous solution 6 of 120 g/liter of sulfuric acid is contained in the anode compartment 5. A cathode 7 composed of a lead (Pb) plate is immersed in the organic electrolytic solution 4. A gas permeable electrode 9 composed of a reaction layer 10 and a gas permeable layer 11 bonded thereto is arranged as an anode 8 in the electrolytic aqueous solution 6. The gas permeable electrode 9 may be also applied to the cathode according to the present invention.

In this case, the reaction layer 10 is composed of fine or minute hydrophilic and hydrophobic portions. That is, hydrophilic carbon black having an average particle size of 420Å, carrying platinum thereon as a catalyst, hydrophobic carbon black having an average particle size of 420Å and polytetrafluoroethylene powders having an average particle size of 0.3 μm are blended and then molded to obtain the reaction layer 10 having a dimension of 0.1 mm (thickness)×100 mm (width)×100 mm (height). The gas permeable layer 11 is composed of fine hydrophobic portions. That is, the hydrophobic carbon black having the average particle size of 420Å and the polytetrafluoroethylene powders having the average particle size of 0.3 μm are blended and then molded to obtain the gas permeable layer 11 having a dimension of 0.4 mm (thickness)×120 mm (width)×120 mm (height). Thus, the obtained reaction layer 10 and the gas permeable layer 11 are bonded to each other to form the gas permeable electrode 9 as the anode 8.

In the electrolysis apparatus described above, while hydrogen gas is supplied to the gas permeable electrode 9 from the gas permeable layer side, the electrolysis is carried out under conditions such as a voltage of 7 to 8 V and an electric current density of 500 mA/cm$^2$ to obtain adiponitrile with 89 to 94% of current efficiency.

Figure 1:
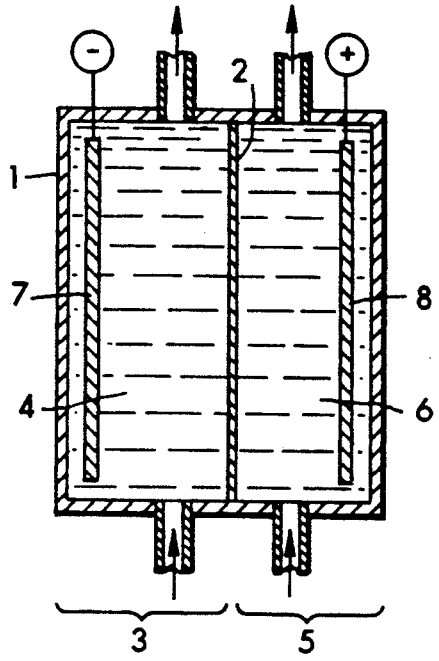
FIG. 1 (PRIOR ART)
FIG. 1 is a longitudinal cross section of a conventional electrolysis apparatus.

For a comparison, in the conventional electrolysis apparatus shown in FIG. 1, the same organic electrolytic solution 4 and sulfuric acid aqueous solution 6 as those used in the above described embodiment according to the present invention are contained in the electrolytic cell 1, and a lead plate having a dimension of 0.5 mm (thickness)×100 mm (width)×100 mm (height) is used for the anode 8. The electrolysis is conducted under conditions such as a voltage of 8.5 to 9.5 V and an electric current density of 500 mA/cm$^2$ to obtain adiponitrile with 90% of current efficiency.

It is readily understood from the above description that, in the electrolysis apparatus according to the present invention, the electrolytic voltage is largely lowered as compared with that of the conventional electrolysis apparatus. Further, the stability of the electrodes is very good, and hence, the distance between the two electrodes can be made small at the beginning of the operation, and can be maintained during the operation as it is. Because of the hydrogen oxidation potential, the affection of the organic compound to the electrodes is remarkably small, and the life of the electrodes can be largely prolonged.

In this embodiment, fine particles of Ni, Au, Pt, Pd or Ir may be used in place of the hydrophilic carbon black carrying the catalyst thereon for preparing the reaction layer 10 of the gas permeable electrode 9 for the anode, and oxides such as $RuO_2$, $IrO_2$ and $PbO_2$ may be also used. For the cathode, a metal such as Au, Cu, Cd, Zn, Sn or In or an alloy thereof, or semiconductor fine particles of GaP or GaAs may be used. By varying the fine particles used for the reaction layers of the electrodes, the produced organic compound can be changed.

When $\beta$-$PbO_2$ is used as the catalyst for the anode, oxygen is produced at the anode penetrating the $\beta$-$PbO_2$ to reach the rear side thereof, and hence, the supply of the hydrogen to the anode is not required.

Further, by anodic reaction in the gas permeable electrode prepared by employing a copper plate and a hydrophilic carbon or $RuO_2$ fine particles as the cathode and anode, respectively, synthesis of butadiene to dichlorobutene, i.e., chlorination can be possible by employing acetonitrile and $CoCl_2$ as the electrolytic solution. In this apparatus, oxidation of a Kolbe reaction radical or the like can be also possible. At this time, the cathode may be depolarized by supplying oxygen thereto.

When a gas permeable electrode is prepared for the cathode by using $\beta$-$PbO_2$ as the catalyst, in the same manner as described above, the reduction of oxalic acid can be effected to obtain glyoxylic acid.

In the above described apparatus, when the electrolysis is carried out while the hydrogen gas is supplied to the gas permeable electrode of the anode, the hydrogen is positively permeated and diffused into the hydrophobic portions of the reaction layer of the gas permeable electrode, and the electrolytic solution is permeated into the hydrophilic portions of the reaction layer to contact the hydrogen. Accordingly, the electric current density is kept high, and the production of the organic compound can be effectively performed to improve the productivity. Further, the stability of the electrodes becomes high, and hence the life of the electrodes is largely extended.

According to the present invention, a gas permeable electrode including a reaction layer composed of minute hydrophilic and hydrophobic portions can be used for at least one of the anode and cathode, and thus the contact area of the electrodes with the electrolytic solution can be enlarged. Also, the electrodes can be depolarized by supplying hydrogen or another gas thereto to restrain the dissipation of the electrodes, and the oxidation-reduction reaction can be effectively carried out, thereby effectively producing an organic compound to improve the productivity.

Although the present invention has been described in its preferred embodiment with reference to the accompanying drawings, it is readily understood that the present invention is not restricted to the above described preferred embodiment, and various changes and modifications may be made in the present invention by those skilled in the art without departing from the spirit and scope of the present invention. The present invention can be, of course, applied to an electrolysis apparatus including an electrolytic cell having no diaphragm.

What is claimed is:

1. A method for preparing an organic compound by electrolysis of an electrolytic solution comprised of an organic solvent and an electrolyte dissolved therein, comprising:

disposing said solvent and electrolyte in a cathode compartment of a cell which is divided into separate cathode and anode compartments by a membrane;

providing an aqueous electrolytic solution in said anode compartment; and providing an electrolyzing potential to said cell while supplying a feed gas to one of said compartments by a gas permeable electrode which is in contact with the electrolyte in said one compartment, said gas permeable electrode having a reaction layer and a gas permeable layer joined together, said reaction layer being composed of minute hydrophilic and hydrophobic carbon black and said gas permeable layer being composed of minute hydrophobic carbon black.

2. The method of claim 1, wherein the gas permeable electrode also includes a gas permeable layer bonded to the reaction layer, for enabling the said feed gas to be fed therethrough to said reaction layer.

3. The method of claim 1 wherein said feed gas comprises hydrogen which is supplied to the gas permeable electrode from the gas permeable layer side.

4. The method of claim 1, wherein the gas permeable electrode is an anode, and the cathode comprises a metal selected from the group consisting of Pb, Au, Cu, Cd, Zn, Sn, In and an alloy thereof.

5. The method of claim 1, wherein the gas permeable electrode is an anode, and the cathode comprises semiconductor fine particles selected from the group consisting of GaP and GaAs.

6. The method of claim 1, wherein the reaction layer of the gas permeable electrode includes a material selected from the group consisting of Ni, Au, Pt, Pd and Ir.

7. The method of claim 1, wherein the electrolytic solution contains and organic solvent of 20% by weight of potassium tetraethylammonium-p-toluene sulfonate and an electrolyte of 30% by weight of acrylonitrile dissolved therein, and the electrolytic aqueous solution is 120 g/liter of sulfuric acid.

8. A method for preparing an organic compound by electrolysis of an organic solvent and an electrolyte dissolved therein, comprising:

disposing said solvent and electrolyte in one compartment of a cell having separate cathode and anode compartments divided by a membrane, into which are disposed respectively, a cathode and an anode, at least one of which comprises a gas permeable electrode having a reaction layer which is in contact with the electrolyte in said one compartment, and further having a gas permeable layer joined with the reaction layer, said reaction layer being composed of minute hydrophilic and hydrophobic carbon black and the gas permeable layer being composed of minute hydrophobic carbon black; and providing an electrolyzing potential to said cell while supplying a feed gas to said gas permeable electrode.

9. The method of claim 8, wherein the gas permeable electrode includes a gas permeable layer bonded to the reaction layer, for enabling the said feed gas to be fed therethrough to said reaction layer.

10. The method of claim 8 wherein said feed gas comprises hydrogen which is supplied to the gas permeable electrode from the gas permeable layer side.

* * * * *